United States Patent [19]

Nishikawa et al.

[11] Patent Number: 4,655,061

[45] Date of Patent: Apr. 7, 1987

[54] CLOCK LOCK

[75] Inventors: Makoto Nishikawa; Takeo Inada; Hiroaki Tomoda; Eiro Naruto; Kazuyuki Oki, all of Hiroshima; Kouichi Hirano, Kure, all of Japan

[73] Assignee: Kumahira Safe Co., Inc., Hiroshima, Japan

[21] Appl. No.: 765,961

[22] Filed: Aug. 15, 1985

[30] Foreign Application Priority Data

Oct. 1, 1984 [JP] Japan ..... 59-205800
Feb. 2, 1985 [JP] Japan ..... 60-19151

[51] Int. Cl.[4] ..... E05B 43/00
[52] U.S. Cl. ..... 70/271
[58] Field of Search ..... 70/271, 267, 268, 269, 70/270, 272, 273, 274; 340/825.31, 825.34, 825.37

[56] References Cited

U.S. PATENT DOCUMENTS 3,835,679 9/1974 Heinemann ..... 70/271
3,950,678 4/1976 Brewer ..... 70/271

*Primary Examiner*—Robert L. Wolfe
*Attorney, Agent, or Firm*—Cushman, Darby & Cushman

[57] ABSTRACT

An improved clock lock of the type using an electronic timer circuit as clock mechanism is disclosed. A locking member is actuated toward the unlocked state in response to unlocking signal generated by the electronic timer circuit. The clock lock includes motors adapted to be activated in response to unlocking signal, cams in operative association with the motors, a movable plate normally held in the locked state in the casing to move toward the unlocked state by means of a first cam when any one of the motors starts its rotation, a locking member normally held at the locked position on the movable plate in the casing to turn to the unlocked position by the effect of moment caused by its own dead weight when it is released from the locked state, and a motor driving circuit which is so designed that none of the motors is activated toward the locked state as long as any one of the motors has failed to finish rotation toward the unlocked state by means of microswitches which are in operative association with second cams. Usually, the locking member is designed in the form of an unbalancedly weighted lever. The first cam is preferably designed in the form of a circular cam which is eccentrically mounted on the cam shaft, while each of the second cams is designed in the form of a sector cam. One of the second cams is mounted on the cam shaft at a delayed angle relative to other ones.

10 Claims, 10 Drawing Figures

CLOCK LOCK

BACKGROUND OF THE INVENTION

1. Field of the Invention

The present invention relates to a clock lock and more particularly to a clock lock mounted on a door on a safe, an emergency outlet or the like to effect unlocking at a preset time.

2. Description of the Prior Art

As is well known, a time lock having a clock mechanism incorporated therein to effect unlocking only at a required time is hitherto mounted on a door on a safe, an emergency outlet or the like. The conventional clock mechanism is constituted by a movement including a spiral spring as main component and its unlocking operation is initiated by mechanical actuating means such as lever or the like which is operatively connected to locking section so as to unlock the locking section with resilient force of the spiral spring which is amplified or enlarged by means of the lever. Due to arrangement of the conventional clock mechanism made in that way it results that unlocking time is roughly set, there is a necessity for making certain allowances for the period of unlocking time, its actuation lacks stability and moreover there is a fear of causing long delay from the preset unlocking time. In principle, the conventional clock mechanism is intended to set relative time and therefore there is a possibility of causing such a malfunction that unlocking is effected at unexpected incorrect time when time calculation with respect to the number of hours as counted from the existing time fails to be made properly. Further, the conventional clock mechanism is generally constituted such that a plurality of movements have to be set to assume their position in alignment with individual calibration line but any malfunction tends to be detected with much delay, because locking can be effected again even when any one of the movements fails to function properly.

SUMMARY OF THE INVENTION

Hence, the present invention has been made with the foregoing background in mind. Problems which are intended to be resolved by the present invention are as follows: Specifically, one of them is a problem which is concerned with the clock mechanism which is required to set unlocking time accurately and correctly. Other one is a problem which is concerned with the lock mechanism by means of which unlocking signal transmitted from the clock mechanism is converted to unlocking function. Another one is a problem which is concerned with reliability on prevention of an occurrence of incorrect operation as well as detection of malfunction.

As is well known, an electric current from an electronic circuit generally has a low intensity. When solenoids having a high sensitivity are employed for converting the above-mentioned electric current into a driving force for the lock mechanism, there is a fear of causing incorrect operation even under the influence of a fine shock. On the contrary, reduction in sensitivity of the solenoids for fear of such incorrect actuations will develop a possibility that certain solenoids do not actuate at all. This necessitates introduction of a fail-safe system and a complicated mechanism of detecting troubles.

Thus, it is an object of the present invention to provide a clock lock of the early mentioned type which assures that unlocking time is set accurately and correctly.

It is another object of the present invention to provide a clock lock of the early mentioned type which is easy to be operated and has a high reliability with respect to inhibition of an occurrence of incorrect function and detection of any malfunction.

It is still another object of the present invention to provide a clock lock of the early mentioned type which assures that setting of unlocking time is carried out in such a manner that unlocking time for the period of one week is set in accordance with a basic schedule, the unlocking time thus set is continuously repeated, any unlocking time can be temporarily changed as required, unlocking time for an irregular holiday such as national holiday or the like can be preset within the range of weekdays in a week so as to keep incapability of unlocking in the above-mentioned holidays while taking precedence over the basic schedule, and the basic schedule can be restored from the next week to effect regular unlocking once temporary change and/or precedence of incapability has been practiced and then cleared.

To accomplish the above objects there is proposed according to the invention a clock lock of the type using an electronic timer circuit as clock mechanism so that a locking member in the lock mechanism is actuated toward the unlocked state in response to unlocking signal generated by the electronic timer circuit, essentially comprising at least one motor adapted to be activated in response to unlocking signal transmitted from the timer circuit, at least two kinds of cams in operative association with each of the motors, a movable member normally held in the locked state by the effect of resilient force of spring means, the movable member being displaced toward the unlocked state by means of a first cam when any one of the motors starts its rotation, the first cam being operatively connected to the motor, a locking member held at the locked position by means of the movable member, the locking member being turned to the unlocked position by the effect of turning moment caused by its own dead weight when it is released from the locked state, and a motor driving circuit which is so designed that none of the motors is actuated toward the locked state as long as any one of the motors has failed to finish rotation toward the unlocked state by means of micro switches which are in operative association with second cams.

The movable member is designed in the form of a movable plate of which bottom part is formed with a plurality of cam receiving recesses for the first and second cams.

Preferably, the locking member is designed in the form of an unbalancedly weighted lever which is turnably supported on the one side wall thereof.

The first cam is usually designed in the form of a circular cam which is eccentrically mounted on a cam shaft extending from each of the motors.

The second cams comprise four sector cams fixedly mounted on the cam shaft and one of the sector cams is mounted thereon at a delayed angle relative to other ones.

Each of the motors rotates a cam shaft on which one circular cam and four sector cams are mounted. The circular cam eccentrically mounted on the cam shaft is brought in contact with the one inside wall of the cam receiving recess on the movable plate. When the longer radius side of the circular cam comes in contact with the one inside wall of the cam receiving recess, unlocking operation is initiated. Microswitches employed for the clock lock are designed in the two-side selection type. Namely, they assume "S-1 side" or "S-2 side" in dependence on rotational angle of the sector cams. (It should be noted that the S-1 side refers to the state where common contact is electrically connected to normal closed contact but it is electrically disconnected from normal open contact and the S-2 side refers to the state reverse to the foregoing one.) As mentioned above, one of the four sector cams is mounted on the cam shaft at a delayed angle as seen in the direction of their rotation so as to limit the period of activation of the motor driving circuit.

Other objects, features and advantages of the invention will become more clearly apparent from reading of the following description which has been prepared in conjunction with the accompanying drawings.

BRIEF DESCRIPTION OF THE DRAWINGS

The accompanying drawings will be briefly described below.

DESCRIPTION OF THE PREFERRED EMBODIMENT

Now, the present invention will be described in a greater detail hereunder wtih reference to the accompanying drawings which schematically illustrate a preferred embodiment of the invention.

Figure 1:
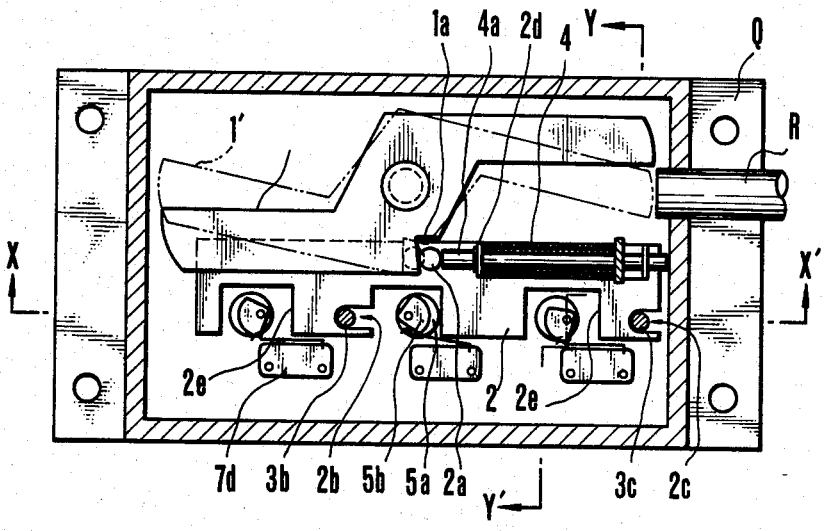
FIG. 1 is a schematic vertical sectional view of a clock lock in accordance with an embodiment of the invention taken in line Z-Z' in FIG. 2.
Figure 2:
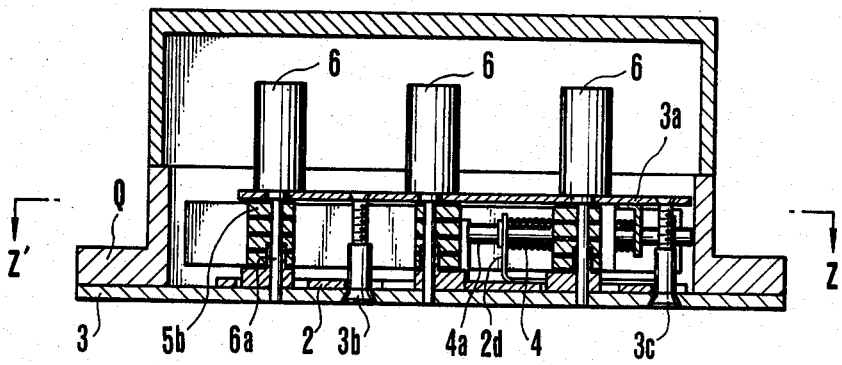
FIG. 2 is a schematic cross-sectional view of the clock lock taken in line X-X' in FIG. 1.

FIG. 1 is a sectional front view of a clock lock in accordance with an embodiment of the invention (as seen on the plane taken in line Z-Z' in FIG. 2) and FIG. 2 is a sectional plan view of the same taken in line X-X' in FIG. 1. As is apparent from the drawings, a casing Q made of metallic material is designed in the box-shaped hollow configuration so that it is attached to a door or the like. The casing Q is provided with a locking rod R adapted to move therethrough in both the directions, that is, leftwardly and rightwardly as seen in the drawings to carry out time locking function. In addition to the locking rod R the door is usually equipped with a normal locking mechanism designed and constructed specially for the door whereby double locking is assured from the door from the viewpoint of crime protection. Obviously, the locking mechanism may function in operative association with the time locking rod R. A locking member 1 is turnably supported in the casing Q to turn within the range as defined between the inhibitive position where the locking rod R is inhibited from entering the casing Q and the acceptable position where it is allowed to enter there. When the locking member 1 assumes the inhibitive position, the clock lock of the invention is kept in the locked state, whereas when it assumes the acceptable position, the clock lock is kept in the unlocked state. As will be best seen from FIG. 1, the locking member 1 is designed in the substantially Z-shaped configuration and its central part is turnably supported in the casing Q. The locking member 1 includes a right wing, a left wing and stepped portions in the middle thereof. The right wing extends in the upper right direction and the left wing extends in the lower left direction. The locking rod slides into the casing Q along the underside of the right wing. It should be noted that the locking member 1 is designed in the unbalanced state relative to weight about the center of its turning moment and in the illustrated design it is caused to turn in the anticlockwise direction as seen in the drawing, that is, in the unlocking direction under the influence of turning movement due to unbalanced weight. However, to inhibit the locking member 1 from excessively turning in the anticlockwise direction it is provided with an engagement cutout 1*a* at the central part thereof with which a driving pin 2*a* on the movable plate 2 is adapted to come in engagement. As illustrated in the drawings, the movable plate 2 is so designed that it slidably moves in the longitudinal direction of the casing Q in parallel with the base plate 3. Further, it is provided with guide grooves 2*b* and 2*c* which extend in the direction of sliding movement thereof and two support rods 3*b* and 3*c* bridged between the base plate 3 and a motor plate 3*a* located opposite to the latter are fitted into the guide grooves 2*b* and 2*c* whereby sliding movement of the movable plate 2 is correctly guided. The movable plate 2 has a spring retainer 2*d* fixedly secured thereto so that it is normally thrusted in the leftward direction as seen in the drawing via the spring retainer 2*d* by the effect of resilient force of the spring 4 until the driving pin 2*a* comes in pressure contact with the engagement cutout 1*a* on the locking member 1. Incidentally, the spring 4 in the form of a coil spring is wound about a spring rod 4*a* which is loosely fitted to the spring retainer 2*d* whereby stable sliding movement of the movable plate 2 is assured. Further, the movable plate 2 includes a plurality of cam receiving cutouts 2*e* of which upper and side dimensions are determined in consideration of dimensions of circular cams 5*a* and of which number correpsonds to the number of circular cams 5*a*. Thus, the movable plate 2 is driven by means of motors via the circular cams 5*a*. Since arrangement is so made such that the movable plate 2 is driven by means of motors only in the unlocking direction, that is, only in the direction of rightward sliding movement as seen in the drawing as will be described later, the cam receiving cutout located at the lefthand end part of the movable plate 2 in the illustrated embodiment may be replaced with the lefthand end face of the same. The clock lock of the invention is provided with three motors 6 in the form of speed reduction geared motors. The motors 6 are mounted on the motor plate 3*a* in the equally spaced relation and their rotating shafts extend through the motor plate 3*a* to rotate three cam shafts 6*a*. Each of the cam shafts 6*a* has a circular cam 5*a* and four sector cams 5*b*. The circular cam 5*a* serves to drive the movable plate 2 and each of the sector cams 5*b* serves to actuate a microswitch 7 which will be described later.

Figure 3:
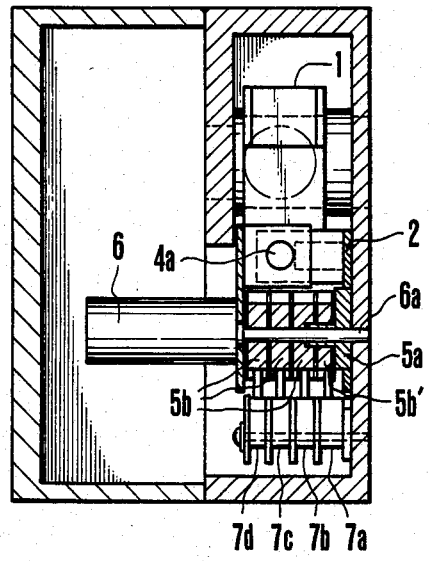
FIG. 3 is a vertical sectional side view of the clock lock taken in line Y-Y' in FIG. 1.

FIG. 3 is a sectional side view of the clock lock taken in line Y-Y' in FIG. 1. As is apparent from FIG. 3, the motor 6 is operatively connected to the cam shaft 6a in the coaxial relation to actuate the movable plate 2 and the four microswitches 7a to 7d via a combination of cams 5a, 5b and 5b'.

Figure 4:
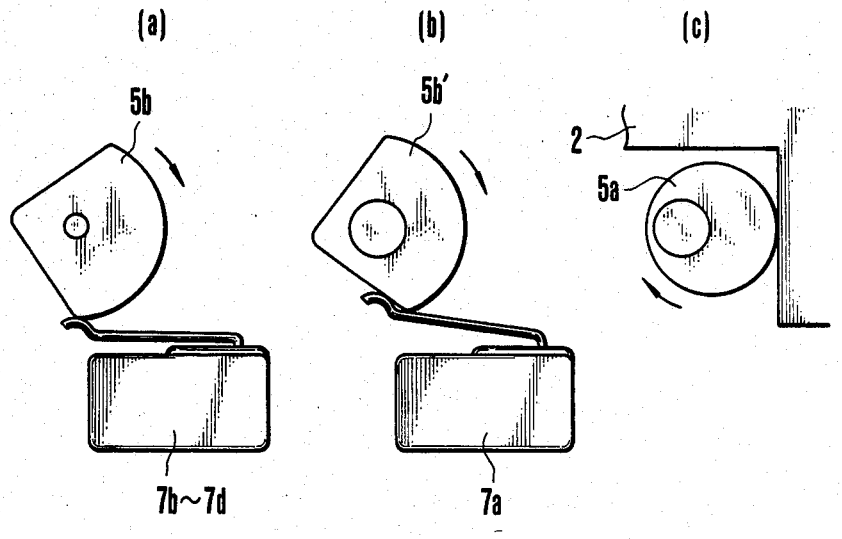
FIG. 4(*a*) to (*c*) are a fragmental sectional front view of the clock lock respectively, particularly illustrating operation of cams.

FIGS. 4(a) to (c) are a fragmental front view of the clock lock, particularly illustrating operative relation between the cam and the movable plate as well as between the cam and the microswitch. Specifically, FIG. 4(a) is intended to illustrate operative relation between three sector cams 5b which are mounted on the cam shaft 6a at the same angle and three microswitches 7b to 7d which come in contact with the sector cams 5b. Next, FIG. 4(b) illustrates operative relation between another sector cam 5b' which is mounted on the cam shaft 6a at a different angle from that of the foregoing sector cams 5b and a microswitch 7a adatped to come in contact with the sector cam 5b'. Finally, FIG. 4(c) illustrates operative relation between the circular cam 5a and the movable plate 2. The circular cam 5a, mounted unsymmetrical relative to the axis of the cam shaft 6a comes in contact with the wall surface of the movable plate 2 to thrust the latter against resilient force of the spring 4 toward the unlocked position where the movable plate 2 is displaced farthest away from the locking member 1. When the movable plate 2 reaches the last mentioned position, the locking member 1 is released from engagment with the movable plate whereby it is caused to turn in the direction of unlocking by the effect of moment caused by its own dead weight. FIGS. 4(a) to (c) illustrate the rotational position of the cams relative to a certain cam shaft respectively. Specifically, when the circular cam 5a assumes the position as illustrated in FIG. 4(c), the three sector cams 5b as illustrated in FIG. 4(a) are kept in the operative state where the microswitches 7b to 7d are depressed thereby. At this moment the state "S-1 side" is reached. On the other hand, as will be apparent from FIG. 4(b), the sector cam 5b' is mounted on the cam shaft 6a at such an angle as delayed from the sector cams 5b as seen in the turning direction and therefore at the foregoing time the microswitch 7a is still kept in the state "S-2 side". As the cam shaft 6a is rotated further from the state as mentioned, the movable plate 2 is caused to come in contact with the shorter radius side of the circular cam 5a whereby it moves toward the locked state by the effect of resilient force of the spring 4. As a result, the microswitch 7a as illustrated in FIG. 4(b) reaches the state "S-1 side". Thus, as time elapses, the three microswitches 7b to 7d in FIG. 4 (a) reaches "S-2 side" in the delayed timing relation.

Figure 5:
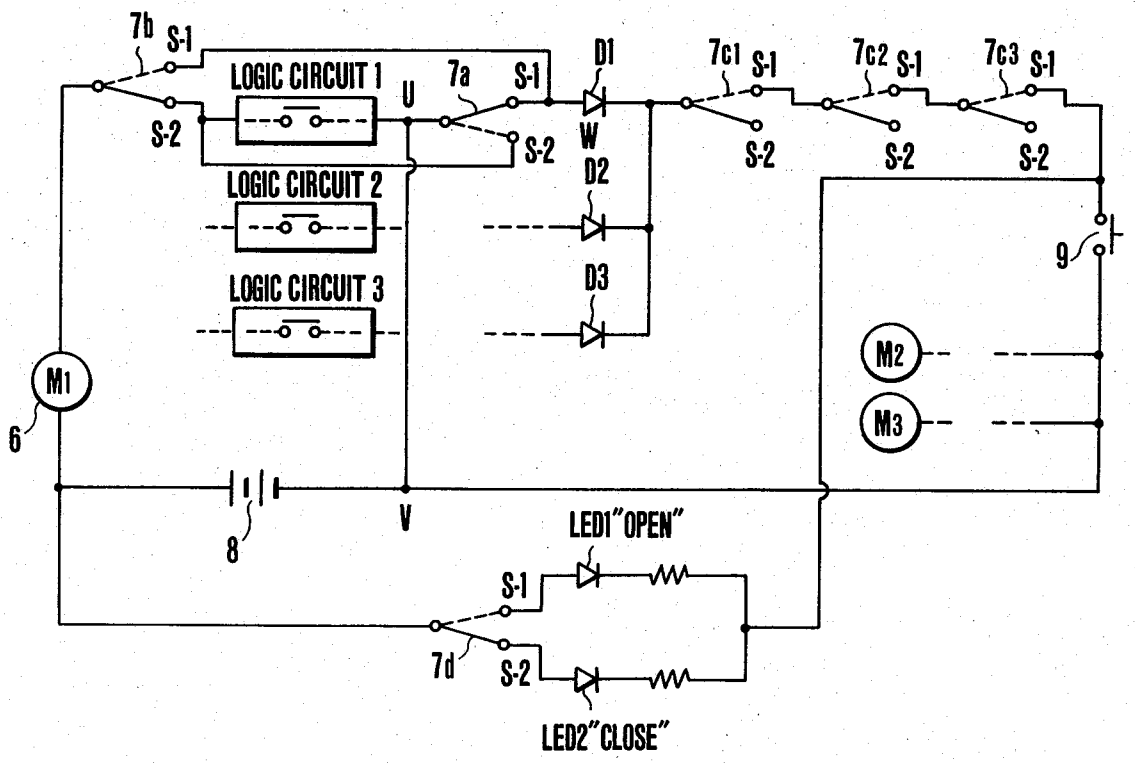
FIG. 5 is a circuit diagram illustrating an example of motor driving circuit.
Figure 6:
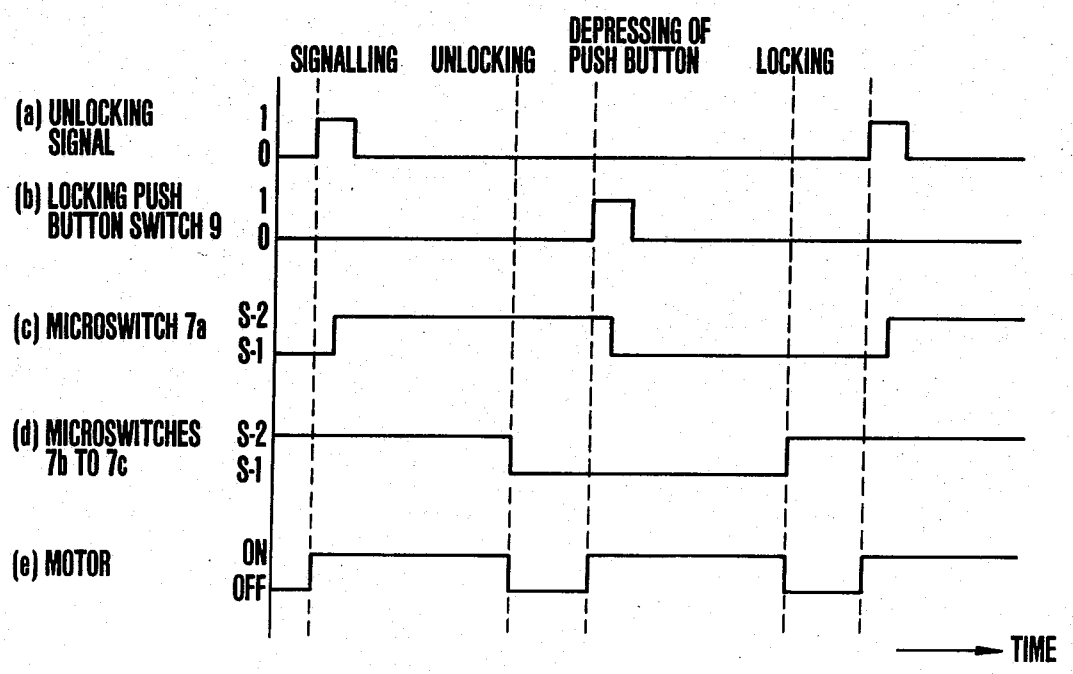
FIG. 6 is a time chart illustrating operation of the motor driving circuit in FIG. 5.

FIG. 5 is a circuit diagram illustrating a motor driving circuit for the clock lock as constructed in the above-described manner and FIG. 6 is a timing chart for the motor driving circuit. As illustrated in FIG. 5, driving voltage for each of the motors 6 is supplied from the power supply source 8 and their turning-on and -off are controlled by logic circuits LC 1 to 3. Further, they are controlled by means of microswitches 7a to 7c and a locking push button 9 both of which are disposed at the predetermined position located midway of the motor driving circuit. It should be noted that among these microswitches the one microswitch 7d is employed for the purpose of display to turn on a display light LED 1 or LED 2 which serves to display the operative or inoperative state of the motor driving circuit. The motors M1 to M3 and the logic circuits LC 1 to 3 are arranged in parallel circuits. In the common circuit microswitches $7c_1$ to $7c_3$ corresponding to each motor are arranged in series and diodes D1 to D3 are arranged at the positions located behind the branch points for the purpose of inhibiting an occurrence of supply of an electric current in the reverse direction whereby mutual interference among the logic circuits LC 1 LC 3 caused due to supply an electric current in the reverse direction is prevented. Specifically, the logic circuits LC 1 to LC 3 are designed and constructed in the form of an integral circuit type clock respectively which includes a clock function as well as a function of generating an unlocking signal when the existing time coincides with the present time which is set through ten keys, control buttons and a display board. Incidentally, one set of ten keys and control buttons for setting unlocking time may be provided for a plurality of logic circuits. In this case inputting is achieved in the parallel relation for each of the logic circuits LC 1 to LC 3.

Figure 7:
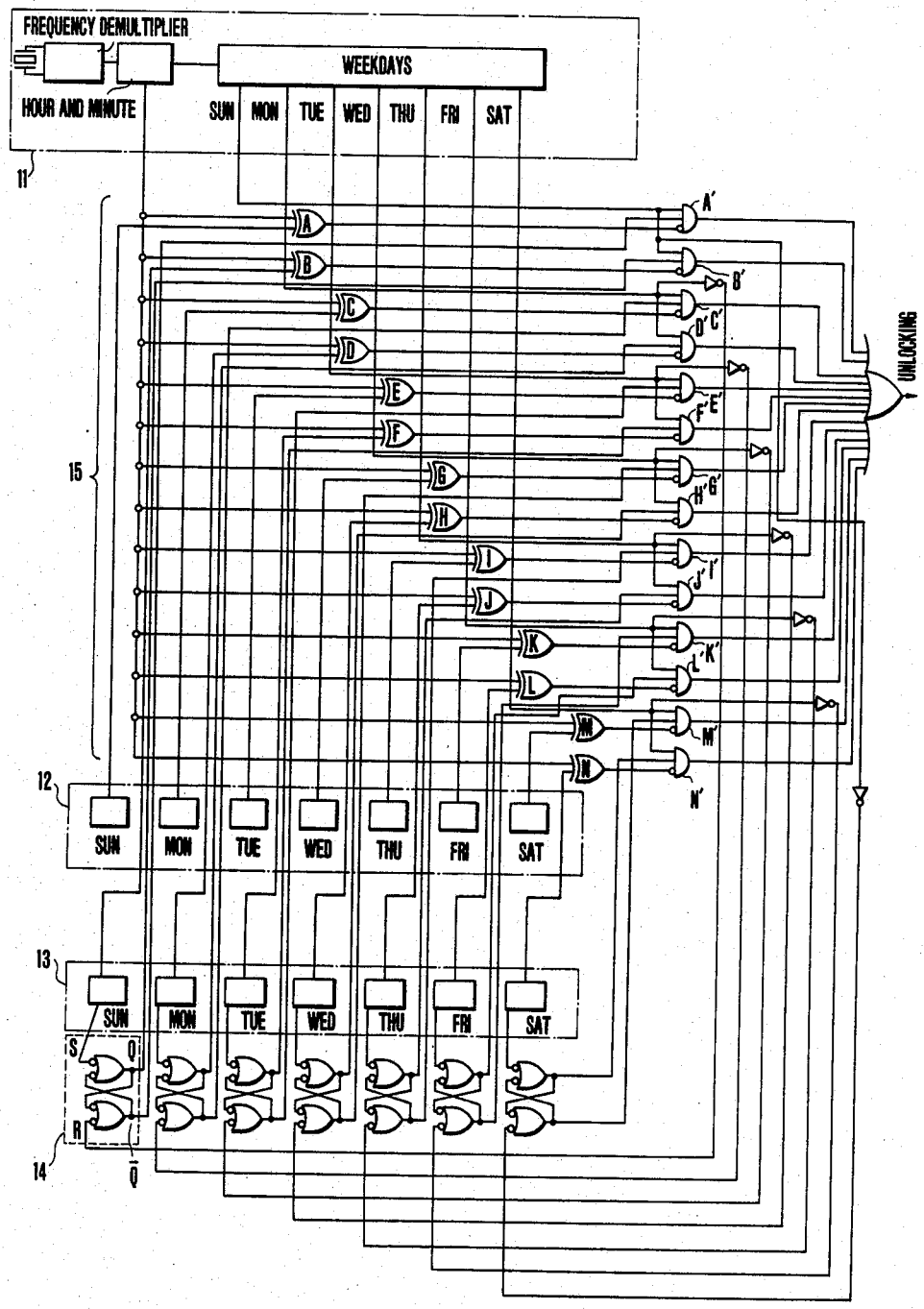
FIG. 7 is a circuit diagram illustrating an example of control section for the clock lock.

FIG. 7 is a circuit diagram illustrating an example of logic circuits for the clock lock of the invention. In the illustrated logic circuit the clock lock includes a digital clock 11 for counting hour, minute and weekday on the assumption that a basic schedule is constituted by one week which is a unit of required counting period, a basic schedule memory 12 for setting unlocking time for each of weekdays and a temporary setting memory 13 for setting items to be changed for each of weekdsays. Their output ends are connected to the combination of logic gates. The logic gates are so designed that the first stage is constituted by exclusive OR gate and the second stage is constituted by AND gate. Each of the logic gates includes exclusive OR gates and AND gates at a rate of one pair for each of weekdays, that is, 14 gates in total. Description will be made below on the assumption that output from exclusive OR gate is identified by reference letters A to N and output from AND gate is identified by reference letters A' to N'. It is preferable from the viewpoint of accuracy that the digital clock 11 is designed in the form of timer circuit with a quartz oscillator or the like employed therefor.

A basic schedule for one week is set by and stored in the basic schedule memory 12 and items to be changed and precedence items are set by and stored in the temporary setting memory 13. To confirm whether temporary setting is made or not a flip-flop 14 is disposed on the output side of the temporary setting memory 13 so that output from the latter as well as output derived from counting a certain weekday by means of the digital clock 11 is inputted into the flip-flop 14. In response to inputting into the flip-flop 14 in that way a signal "1" or "0" is delivered to each of the pairs of AND gates A' to N'.

Figure 8:
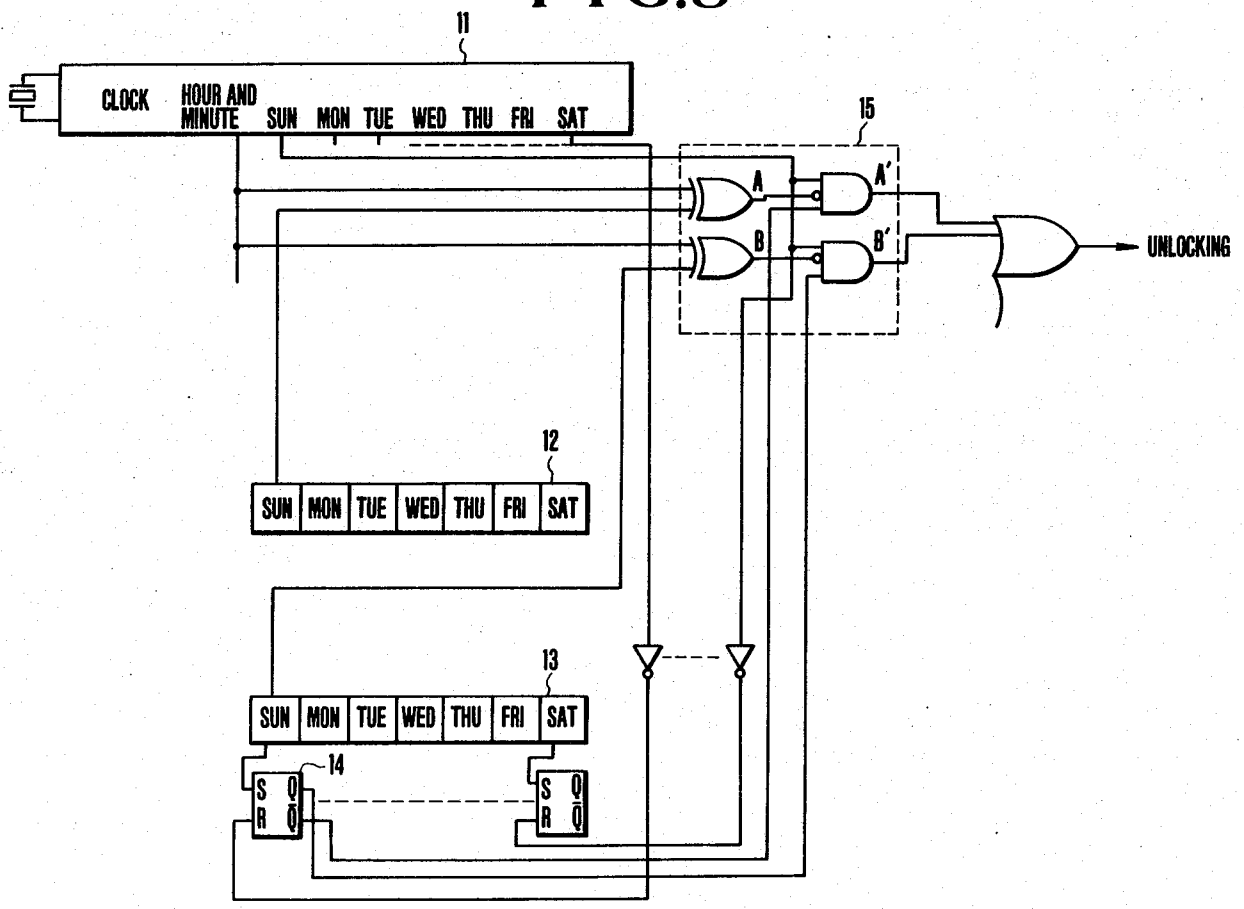
FIG. 8 is a fragmental circuit diagram of the control section in FIG. 7.

FIG. 8 is a fragmental circuit diagram illustrating a part of the control circuit with respect to a certain day selected from weekdays to facilitate understanding of the foregoing embodiment. Now, the present invention will be described below in more details with reference to FIGS. 7 and 8.

Signal relative to hour and minute is outputted from the digital clock 11 during one day and when the content of signal coincides with the content of the basic schedule memory 12 or the temporary setting memory 13, outputs A to N from the exclusive OR gates in the first stage are shifted to "0". Outputs A' to N' from the AND elements which have been activated in response to output from the exclusive OR gates are shifted to such a state that outputting can be achieved only from gates which are adapted to output information concerning weekday. For instance, when the day to be discussed here is Sunday, output A′ or B′ is obtainable. When data concerning hour and minute stored in the Sunday memory of the basic schedule coincide with data concerning hour and minute transmitted from the digital clock 11, output A is shifted to "0" whereby AND element relative to output A′ is activated. Further, when the day to be discussed here is a certain weekday and the digital clock 11 has output derived from counting of the weekday, outputting is achieved from A′ whereby an unlocking signal is generated. If setting is already made in the temporary setting memory 13 (on the assumption that S input is "0" at the time of setting) Q, output from flip-flop 14 becomes "1" and Q output becomes "0". As a result, AND gate A′ fails to effect outputting but outputting from B′ can be achieved. Thus, setting of items to be changed as well as setting of precedence are carried out. The flip-flop 14 is then reset, because the next day is a different weekday, whereby outputting from the basic schedule memory 12 becomes effective from the next cycle of operation.

If the weekday to be discussed here is an irregular holiday, data such as 25:00 or the like with which no coincidence takes place in any way are inputted in the temporary setting memory. This causes no coincidence to take place with respect to hour and minute irrespective of the fact that output from B′ has precedence whereby an unlocking signal fails to be outputted. When the day to be discussed here in a weekday, reset output is derived from Q output and thereby the flip-flops are restored to the original state. Thus, operation is performed again from the next cycle of operation in accordance with the basic schedule.

Now, a typical example of operation with the clock lock of the invention will be noted below.

When 8:30 is set by means of the basic schedule memory 12 with respect to Monday to Saturday, unlocking is effected at 8:30 from Monday to Saturday. If it is required that no unlocking is effected to an irregular holiday within weekdays or time of unlocking is changed to the end day of a month or the like day, temporary setting is made by means of the temporary setting memory 13 on the day before the first mentioned day. This causes unlocking to be normally effected at 8:30. In case when time of unlocking is changed for an irregular holiday in a week, unlocking is effected at the changed time only in this week but it is effected again at the normal time of 8:30 from the next week.

Next, description will be made again below as to unlocking operation to be performed when an unlocking signal is outputted from the logic circuit IC 1 with reference to FIGS. 5 and 6.

(a) While the clock lock is kept in the locked state, the microswitches *7b* to *7d* are shifted to "S-2 side" and the microswitch *7a* is shifted to "S-1 side".

(b) When the existent time coincides with the preset unlocking time, the logic circuit IC 1 generates an unlocking signal having the pulse in a wave-shaped configuration as illustrated in FIG. 6(*a*) (hereinafter referred to as unlocking signal pulse).

(c) When the microswitch *7b* is on "S-2 si1de", the driving circuit extending via U point and V point is caused to close in response to the unlocking signal pulse whereby the motors 6 and the cams *5a*, *5b* and *5b′* start their rotation.

(d) When the microswitch *7b* is on "S-1 side" at this moment, the driving circuit is not closed. Thus, the motors 6 do not start their rotation.

(e) As the motors 6 and the cam *5b′* are rotated, the microswitch *7a* is displaced past the shifting point where "S-1 side" is shifted to "S-2 side" and thereby the driving circuit is activated with the aid of a bypass circuit irrespective of signal pulse from the logic circuit LC 1. As a result, the motors 6 continue their rotation until the microswitch *7b* is shifted to "S-1 side".

(f) The motors 6 and the cams displace the movable plate 2 backwardly against resilient force of the spring 4 until the locking member 1 is released from the locking state. When the cams *5a*, *5b* and *5b′* assume the position as illustrated in FIG. 4, unlocking is completed. As a result, the microswitch *7b* is shifted from "S-2 side" to "S-1 side" whereby the unlocking circuit is interrupted and the motors 6 and the cams *5a*, *5b* and *5b′* are caused to stop.

(g) When the locking member 1 is kept free from the locked state, it is turned (to the position as identified by real lines in FIG. 1) in the anticlockwise direction under the influence of its own dead weight until the completely unlocked state is assured.

(h) Each of three logic circuits LC 1 to LC 3 functions in the above-described manner to actuate their unlocking means. It should be emphasized that the locking member 1 reaches the fully unlocked position by unlocking operation of one of the above-mentioned unlocking means.

(i) When the locking means 1 reaches the unlocked position, the time lock rod R is ready to enter the casing of the clock lock. Thus, the locking rod on the door becomes free from locking operation of the time lock. Accordingly, when any other lock is unlocked, the door can be opened.

Next, description will be made below as to locking operations.

(a) After completion of unlocking operation as described above each of the cams assumes the position as illustrated in FIG. 4. The microswitch *7a* is on "S-2 side" and the microswitches *7b* to *7d* are on "S-1 side".

(b) When the locking push button 9 is manually depressed, the locking circuit extending via point W in FIG. 5 is caused to close and the circuit extending via "S-1 side" of the microswitch *7b* is activated whereby the motors 6 and the cams *5a*, *5b* and *5b′* start their rotation.

(c) If any one of the microswitches $7c_1$ to $7c_3$ which are in operative association with the motors 6 is on "S-2 side", the circuit fails to be closed and thereby the motors 6 do not start their rotation. This means that locking can not be effected when any one of the cam shafts *6a* has not completed its unlocking operation.

(d) As the motors 6 and the cams *5a*, *5b* and *5b′* are rotated, the microswitch *7a* is shifted from "S-2 side" to "S-1 side" in the delayed timing relation as described above. After completion of shifting operation in that way the driving circuit extending via point U and point V in FIG. 5 becomes activated and then the motors 6 continue their rotation irrespective of whether the locking push button switch 9 is depressed or not, until the microswitch *7b* is shifted to "S-2 side".

(e) While the locking push button switch 9 is depressed, the display circuit is kept in the activated state. When the cams *5a*, *5b* and *5b′* are located at the unlocking position, the microswitch *7d* is held on "S-1 side" and thereby the unlocking display light LED 1 is turned on. When the cams *5a*, *5b* and *5b′* reach the locking position by rotation of the motors 6, the microswitches *7b* to *7d* are shifted to "S-2 side" as illustrated in FIGS.

6(*d*) and 6(*e*). Thus, the motors 6 stop their rotation, the unlocking display light LED 1 is turned off and the locking display light LED 2 is turned on.

(f) When it is confirmed with respect to all of the logic circuits LC 1 to LC 3 that the locking display lights are turned on, the movable plate 2 is brought in the locked state. Since this means completion of locking operation, the locking push button switch 9 is released from the depressed state, if it is found that the depressed state is still maintained. The locking display lights are turned off.

(g) When all the motors 6 and the cams 5*a*, 5*b* and 5*b'* are held in the locked state, the movable plate 2 allows the driving pin 2*a* to come in operative engagement with the locking member 1 by the effect of resilient force of the spring 4 so as to cause the locking member 1 to turn in the locking direction.

(h) The door is closed and the time lock rod is then drawn. The locking member 1 is turned to the locking position under the influence of the resilient force of spring 4 and thereby time locking is ready to be effected (see the position as identified by phantom lines which are represented by reference numeral 1' in FIG. 1).

As will be readily understood from the above description, the clock lock of the invention is constructed in the form of a safety mechanism which has characterizing features that an occurrence of incorrect operation due to shock transmitted from the outside is inhibited by the combination of cams 5*a*, 5*b* and 5*b'* adapted to be actuated by motors 6 and movable plate 2 serving as a movable member, unlocking is effected by actuation of at least one of three sets of combinations comprising the motors 6 and the cams 5*a*, 5*b* and 5*b'* and locking cannot be effected again by the combination of cams 5*a*, 5*b* and 5*b'* and microswitches 7*a* to 7*d* when any one of three sets of combinations comprising the motors 6 and the cams 5*a*, 5*b* and 5*b'* fails to be actuated.

It should be noted that the present invention should not be limited only to the illustrated embodiment. As another embodiment of the invention it is possible that the logic circuits LC 1 to LC 3 including ten keys, operation buttons and time display board for setting the time of unlocking are separated from the clock lock in the form of an unit for the purpose of remote controlling and both the clock lock and the logic circuits are connected with one another by way of cables required for wiring therebetween. As required, optical fiber may be employed for the cables so as to carry out signal converting.

Further, as still another embodiment of the invention it is also possible that each of the cam shafts is provided with a microswitch in order to assure that setting of unlocking time in the logic circuits LC 1 to LC 3 can not be carried out as long as any one of the unlocking mechanisms has failed to complete unlocking operation, an arrangement is so made that the microswitches are shifted to "S-2 side" on completion of unlocking operation and AND circuit is provided on the S-2 side so as to allow setting of unlocking time in the logic circuits to be effectively inputted thereinto only when AND conditions are established, that is, only when unlocking operation is completed. In this embodiment it is easier to detect any malfunction of the clock lock.

As will be apparent from the above description, the present invention has provided a clock lock which assures that unlocking time can be accurately and correctly set, it can be constructed in the simple structure and operated easily and inhibition of an occurrence of incorrect operation and detection of malfunction can be achieved reliably because locking is not effected again when any one of three sets of locking mechanisms fails to function properly.

Now, advantageous features of the clock lock of the invention will be noted below.

(a) It is possible to set unlocking time by unit of minute. Unlocking can be effected at a time which is set more accurately than in the case of the hitherto known clock lock. No fluctuation left in the unlocking mechanisms causes to eliminate the necessity of taking into account allowances for unlocking time.

(b) Unlocking time is set not in the form of relative time as is seen with the conventional clock lock but in the form of absolute time. Therefore, there are very few possibilities of causing malfunction or the like.

(c) It is possible to set a plurality of unlocking times within a preset period of time. Further, it is possible to carry out repeated signalling.

(d) Setting of unlocking time can be changed as required.

(e) Addition of the temporary setting memory in the clock lock makes it possible to set unlocking time even in an irregular holiday or the like within weekdays in a week. Therefore, it is possible to adjust unlocking time set in accordance with the basic schedule.

(f) It is easy to carry out remote controlling even in the case where the clock lock is mounted on a door which is located at an elevated area or narrow area, because controlling section such as logic circuit or the like can be separated from the clock lock. Further, it is possible to electrically find whether the clock lock is kept in the locked state or in the unlocked state or whether there is any abnormality taking place in it or not.

(g) It is possible to detect reduction in voltage of electricity supplied from power source and breakage or damage of circuits in the clock lock when controlling section has a function of self-diagnosis.

While the present invention has been described above with respect to a preferred embodiment, it should of course be understood that it should not be limited only to this but various changes or modifications may be made in any acceptable manner without departure from the spirit and scope of the invention as defined by the appended claims.

What is claimed is:

1. A clock lock of the type using an electronic timer circuit as a clock mechanism so that a locking member in a lock mechanism is actuated toward an unlocked state in response to an unlocking signal generated by said electronic timer circuit, comprising:

at least one motor adapted to be activated in response to the unlocking signal transmitted from the electronic timer circuit, a first cam and a second cam in operative association with said at least one motor, a spring means having a movable member normally held in a locked state, said movable member being displaced toward an unlocked state by said first cam when said at least one motor starts its rotation, a locking member held at a locked position by the movable member, said locking member being turned to an unlocked position by the effect of a turning moment caused by its own dead weight when it is released from the locked position, a plurality of microswitches, in operative association with said second cam, for turning on and off driving voltage for said at least one motor, and a motor driving circuit adapted so that said at least one motor is not actuated to turn said movable member toward a locked state until said at least one motor has failed to finish rotation toward an unlocked state.

2. A clock lock as defined in claim 1, wherein the movable member is a movable plate of which a bottom part is formed with a plurality of cam receiving recesses for the first and second cams, said movable plate having the spring means carried on one side wall thereof.

3. A clock lock as defined in claim 1, wherein the locking member is an unbalanced weight lever which is turnably supported on one side wall thereof.

4. A clock lock as defined in claim 1, wherein the first cam is circular and is eccentrically mounted on said at least one motor.

5. A clock lock as defined in claim 1, wherein the second cam includes four sector cams, one of the sector cams being fixedly mounted said at least one motor at an offset angle as seen in the direction of rotation.

6. A clock lock as defined in claim 1, wherein the electronic timer circuit is an integrated circuit clock adapted to set an unlocking time and includes a circuit adapted to generate the unlocking signal when real time coincides with the unlocking time.

7. A clock lock as defined in claim 1, wherein the electronic timer circuit is a digital clock which emits the unlocking signal via a combination of logic circuits only at a preset time, said combination of logic circuits being adapted to set an unlocking time for a required period of time in accordance with a basic schedule, said unlocking time being set such that it is continuously repeated as long as another new setting is not made, said unlocking time being set such that either or both of a temporary change in the unlocking time and priority of incapability of unlocking during an irregular holiday within weekdays in a week can be done and the basic schedule can be restored for the next week once said temporary change and/or priority of incapability has been completed and then cleared.

8. A clock lock as defined in claim 1, wherein the clock mechanism is an apparatus which can be remotely controlled via a cable extending between the clock mechanism and the lock mechanism.

9. A clock lock as defined in claim 8, wherein the clock mechanism has means for preventing resetting of the unlocking time as long as the lock mechanism has failed to complete an unlocking operation.

10. A clock lock as defined in claim 6, wherein the electronic timer circuit is a digital clock which emits the unlocking signal via a combination of logic circuits only at a preset time, said combination of logic circuits being adapted to set an unlocking time for a required period of time in accordance with a basic schedule, said unlocking time being set such that it is continuously repeated as long as another new setting is not made, said unlocking time being set such that either or both of a temporary change in the unlocking time and priority of incapability of unlocking during an irregular holiday within weekdays in a week can be done and the basic schedule can be restored for the next week once said temporary change and/or priority of incapability has been completed and then cleared.

* * * * *